US006456184B1

(12) United States Patent
Vu et al.

(10) Patent No.: US 6,456,184 B1
(45) Date of Patent: Sep. 24, 2002

(54) REDUCED-COST CORE FOR AN ELECTRICAL-POWER TRANSFORMER

(75) Inventors: Tri D. Vu, Apex; Varagur R. Ramanan; Arthur L. Lanni, both of Cary, all of NC (US)

(73) Assignee: ABB Inc., Raleigh, NC (US)

( * ) Notice: Subject to any disclaimer, the term of this patent is extended or adjusted under 35 U.S.C. 154(b) by 11 days.

(21) Appl. No.: 09/752,911

(22) Filed: Dec. 29, 2000

(51) Int. Cl.[7] ..... H01F 27/24; H01F 30/12

(52) U.S. Cl. ..... 336/234; 336/5; 336/218; 336/217; 336/232

(58) Field of Search ..... 336/200, 223, 336/232, 212, 234, 213, 5, 218, 217; 29/606, 602.1

(56) References Cited

U.S. PATENT DOCUMENTS

| | | | | | |
|---|---|---|---|---|---|
| 3,878,495 | A | | 4/1975 | Thomas | 336/212 |
| 4,205,288 | A | | 5/1980 | Lin et al. | 336/5 |
| 4,422,061 | A | | 12/1983 | Yamamoto et al. | 336/218 |
| 4,520,335 | A | | 5/1985 | Rauch et al. | 336/212 |
| 4,531,108 | A | * | 7/1985 | Brandes | 336/5 |
| 4,557,039 | A | * | 12/1985 | Manderson | 29/605 |
| 4,668,931 | A | | 5/1987 | Boenitz | 336/212 |
| 4,761,630 | A | * | 8/1988 | Grimes et al. | 336/213 |
| 4,972,573 | A | * | 11/1990 | Yamamoto et al. | 29/609 |
| 4,993,141 | A | * | 2/1991 | Grimes et al. | 29/606 |
| 5,371,486 | A | | 12/1994 | Yamada et al. | 336/212 |
| 6,100,783 | A | | 8/2000 | Hopkinson et al. | 336/216 |

* cited by examiner

*Primary Examiner*—Anh Mai
(74) *Attorney, Agent, or Firm*—Woodcock Washburn LLP

(57) ABSTRACT

A reduced-cost core for an electrical-power transformer comprises at least a first magnetic loop and a second magnetic loop. The first and the second magnetic loops are positioned substantially side by side to form a winding leg for a phase winding. The first magnetic loop includes a first plurality of laminae each having a first thickness, and the second magnetic loop includes a second plurality of laminae each having a second thickness, where the second thickness is less than the first thickness.

23 Claims, 5 Drawing Sheets

| Induction Level (teslas) | Baseline Core Losses (watts) | Core Losses "B-A-A-B" core (watts) [% reduction] | Core Losses "A-B-A-B" core (watts) [% reduction] | Core Losses "A-B-B-A" core (watts) [% reduction] |
|---|---|---|---|---|
| 1.80 | 400.3 | 398.5 [0.4] | 381.3 [4.7] | 397.1 [0.8] |
| 1.70 | 314.2 | 308.0 [2.0] | 297.0 [5.5] | 304.8 [3.0] |
| 1.60 | 254.5 | 248.1 [2.5] | 238.5 [6.3] | 246.5 [3.1] |
| 1.50 | 214.8 | 208.0 [3.2] | 201.6 [6.1] | 207.4 [3.4] |
| 1.40 | 182.0 | 173.6 [4.6] | 169.4 [6.9] | 177.4 [2.5] |
| 1.30 | 158.7 | 148.1 [6.7] | 145.7 [8.2] | 150.5 [5.2] |
| 1.00 | 96.4 | 88.0 [8.7] | 86.8 [10] | 88.0 [8.7] |

FIG. 3

REDUCED-COST CORE FOR AN ELECTRICAL-POWER TRANSFORMER

FIELD OF THE INVENTION

The present invention relates to magnetic-induction devices. More specifically, the invention is directed to a reduced-cost core for an electrical-power transformer.

BACKGROUND OF THE INVENTION

Electrical-power transformers are used extensively in electrical and electronic applications. Transformers transfer electric energy from one circuit to another circuit through magnetic induction. Transformers are utilized to step electrical voltages up or down, to couple signal energy from one stage to another, and to match the impedances of interconnected electrical or electronic components. Transformers are also used to sense current, and to power electronic trip units for circuit interrupters. Transformers may also be employed in solenoid-equipped magnetic circuits, and in electric motors.

A typical transformer includes two or more multi-turned coils of wire commonly referred to as "phase windings." The phase windings are placed in close proximity so that the magnetic fields generated by each winding are coupled when the transformer is energized. Most transformers have a primary winding and a secondary winding. The output voltage of a transformer can be increased or decreased by varying the number of turns in the primary winding in relation to the number of turns in the secondary winding.

The magnetic field generated by the current passing through the primary winding is typically concentrated by winding the primary and secondary coils on a core of magnetic material. This arrangement increases the level of induction in the primary and secondary windings so that the windings can be formed from a smaller number of turns while still maintaining a given level of magnetic-flux. In addition, the use of a magnetic core having a continuous magnetic path ensures that virtually all of the magnetic field established by the current in the primary winding is induced in the secondary winding.

An alternating current flows through the primary winding when an alternating voltage is applied to the winding. The value of this current is limited by the level of induction in the winding. The current produces an alternating magnetomotive force that, in turn, creates an alternating magnetic flux. The magnetic flux is constrained within the core of the transformer and induces a voltage across in the secondary winding. This voltage produces an alternating current when the secondary winding is connected to an electrical load. The load current in the secondary winding produces its own magnetomotive force that, in turn, creates a further alternating flux that is magnetically coupled to the primary winding. A load current then flows in the primary winding. This current is of sufficient magnitude to balance the magnetomotive force produced by the secondary load current. Thus, the primary winding carries both magnetizing and load currents, the secondary winding carries a load current, and the core carries only the flux produced by the magnetizing current.

Modern transformers generally operate with a high degree of efficiency. All magnetic devices such as transformers, however, undergo losses because some fraction of the input energy to the device is inevitably converted into unwanted heat. The most obvious type of unwanted heat generation is ohmic heating that occurs in the phase windings due to the resistance of the windings.

Two other forms of losses occur in the transformer core as a result of hysteresis and eddy currents. These losses are collectively referred to as "core losses." Hysteresis losses represent the energy required to overcome molecular friction within the core. This friction is caused by the many reversals that the molecules in the core undergo every second due to the effects of the alternating magnetic flux. Hysteresis losses are typically reduced by constructing the core from special materials such as textured silicon steel. Eddy current losses are ohmic losses that result from the circulation of eddy currents within the core. The eddy currents are produced as the core is cut by the magnetic flux generated in the windings. Eddy-current losses are typically reduced by forming the core from thin laminae of iron or steel.

Transformer cores commonly comprise two or more magnetic loops arranged side by side. For example, FIG. 1 depicts a conventional three-phase transformer 98 comprising a core 100 having four magnetic loops 102. The loops 102 are arranged side by side so as to form three winding legs 110. A phase winding 112 is disposed around each winding leg 110 so that each phase winding 112 is inductively coupled to its respective winding leg 110 when the transformer 98 is energized.

Each of the magnetic loops 102 is wound from a narrow, thin strip of magnetic material such as textured silicon steel or an amorphous alloy. In other words, each of the magnetic loops 102 is made up of a plurality of laminae 103 formed by a single winding of magnetic material. FIGS. 1A and 1B are diagrammatic illustrations depicting portions of the laminae 103 of two adjacent loops 102. The sizes of the laminae 103 are exaggerated in these figures, for clarity.

The cores losses that occur in each loop 102, in general, are proportionate to the thickness of the strip material from which the loop 102 is formed (in particular, the thinner material provides a smaller flow-path for the loss-inducing eddy currents). The cost of the thinner material, however, is generally higher than that of the thicker material. Hence, an optimal transformer design must balance material costs against the need to minimize core losses. Manufacturers of electrical-power transformers are under constant pressure from their customers to minimize both the purchase cost and the operating costs of their products. Hence, an ongoing need exists for reduced-cost, efficient transformers.

Each of the four magnetic loops 102 is typically formed from strips of material having a substantially identical thickness (see, e.g., FIGS. 1A and 1B). This practice is followed in order to equalize the level of induction and the resulting core losses in each of the winding legs 110. The noted practice is dictated by a widely-held belief among skilled transformer designers that the overall core losses in a core such as the core 100 are equal to the numerical average of the core losses in the individual magnetic loops 102, regardless of whether the loops 102 are operating under identical conditions. Hence, a potential cost savings associated with reducing the thickness of the materials from which one or more, but not all, of the loops 102 are formed cannot be realized according to the currently-accepted teachings in the art of transformer design.

SUMMARY OF THE INVENTION

An object of the present invention is to provide an electrical-power transformer having a reduced-cost core. In accordance with this object, a presently-preferred embodiment of the invention provides an electrical-power transformer comprising a core comprising a first magnetic loop including a first winding formed by a first strip of magnetic material having a first thickness, and a second magnetic loop including a second winding formed by a second strip of magnetic material having a second thickness. The second thickness is less than the first thickness, and the first and the second magnetic loops are positioned substantially side by side so that the first and the second magnetic loops form a winding leg. The transformer also comprises a phase winding that encircles the winding leg so that the phase winding and the winding leg are inductively coupled when the transformer is energized.

Further in accordance with the above-noted object, another presently-preferred embodiment of the invention provides an electrical-power transformer comprising a core comprising a first magnetic loop including a first plurality of laminae each having a first thickness, and a second magnetic loop including a second plurality of laminae each having a second thickness. The second thickness is less than the first thickness, and the first and the second magnetic loops are positioned substantially side by side so that the first and the second magnetic loops form a winding leg. The transformer also comprises a phase winding that encircles the winding leg so that the phase winding and the winding leg are inductively coupled when the transformer is energized.

Another object of the present invention is to provide a reduced-cost core for an electrical-power transformer. In accordance with this object, another presently-preferred embodiment of the invention provides a core for a three-phase electrical-power transformer, comprising a first, a second, a third, and a fourth magnetic loop. The first, second, third, and fourth magnetic loops are positioned substantially side by side in the recited order to provide three winding legs and two outer legs. The first magnetic loop includes a first winding formed by a first strip of magnetic material having a first thickness, and the second magnetic loop includes a second winding formed by a second strip of magnetic material having a second thickness. The third magnetic loop includes a third winding formed by a third strip of magnetic material having substantially the second thickness, and the fourth magnetic loop includes a fourth winding formed by a fourth strip of magnetic material having substantially the first thickness.

Further in accordance with the above-noted object of providing a reduced-cost transformer core, another presently-preferred embodiment of the invention provides a core for a three-phase electrical-power transformer, comprising a first, a second, a third, and a fourth magnetic loop. The first, second, third, and fourth magnetic loops are positioned substantially side by side in the recited order to provide three winding legs and two outer legs. The first magnetic loop includes a first plurality of laminae each having a first thickness, and the second magnetic loop includes a second plurality of laminae each having a second thickness. The third magnetic loop includes a third plurality of laminae each having substantially the second thickness, and the fourth magnetic loop includes a fourth plurality of laminae each having substantially the first thickness.

A further object of the present invention is to provide a reduced-cost core for a magnetic-induction device. In accordance with this object, another presently-preferred embodiment of the invention provides a core for a magnetic-induction device comprising a first magnetic loop including a first winding formed by a first strip of magnetic material having a first thickness, and a second magnetic loop including a second winding formed by a second strip of magnetic material having a second thickness. The second thickness is less than the first thickness, and the first and the second magnetic loops are positioned substantially side by side so that the first and the second magnetic loops form a winding leg for a phase winding.

Further in accordance with the above-noted object of providing a reduced-cost core for a magnetic-induction device, another presently-preferred embodiment of the invention provides a core for a magnetic-induction device comprising a first magnetic loop including a first plurality of laminae each having a first thickness, and a second magnetic loop including a second plurality of laminae each having a second thickness. The second thickness is less than the first thickness, and the first and the second magnetic loops are positioned substantially side by side so that the first and the second magnetic loops form a winding leg for a phase winding.

BRIEF DESCRIPTION OF THE DRAWINGS

The foregoing summary, as well as the following detailed description of a presently-preferred embodiment, is better understood when read in conjunction with the appended drawings. For the purpose of illustrating the invention, the drawings show an embodiment that is presently preferred. The invention is not limited, however, to the specific instrumentalities disclosed in the drawings. In the drawings:

FIG. 3 is a tabular compilation of core-loss data acquired from transformers constructed in accordance with the present invention.

DESCRIPTION OF PREFERRED EMBODIMENTS

The present invention provides a reduced-cost core for a magnetic-induction device such as an electrical-power transformer. A presently-preferred embodiment of the invention is described in connection with a three-phase transformer having a four-loop, five legged core. This embodiment is presented for exemplary purposes only. The invention can also be used in conjunction with transformer cores having substantially different configurations, e.g., a two-loop, three-legged core for use in a single-phase transformer. In addition, the invention can be applied to magnetic-induction devices other than electrical-power transformers.

Figure 1:
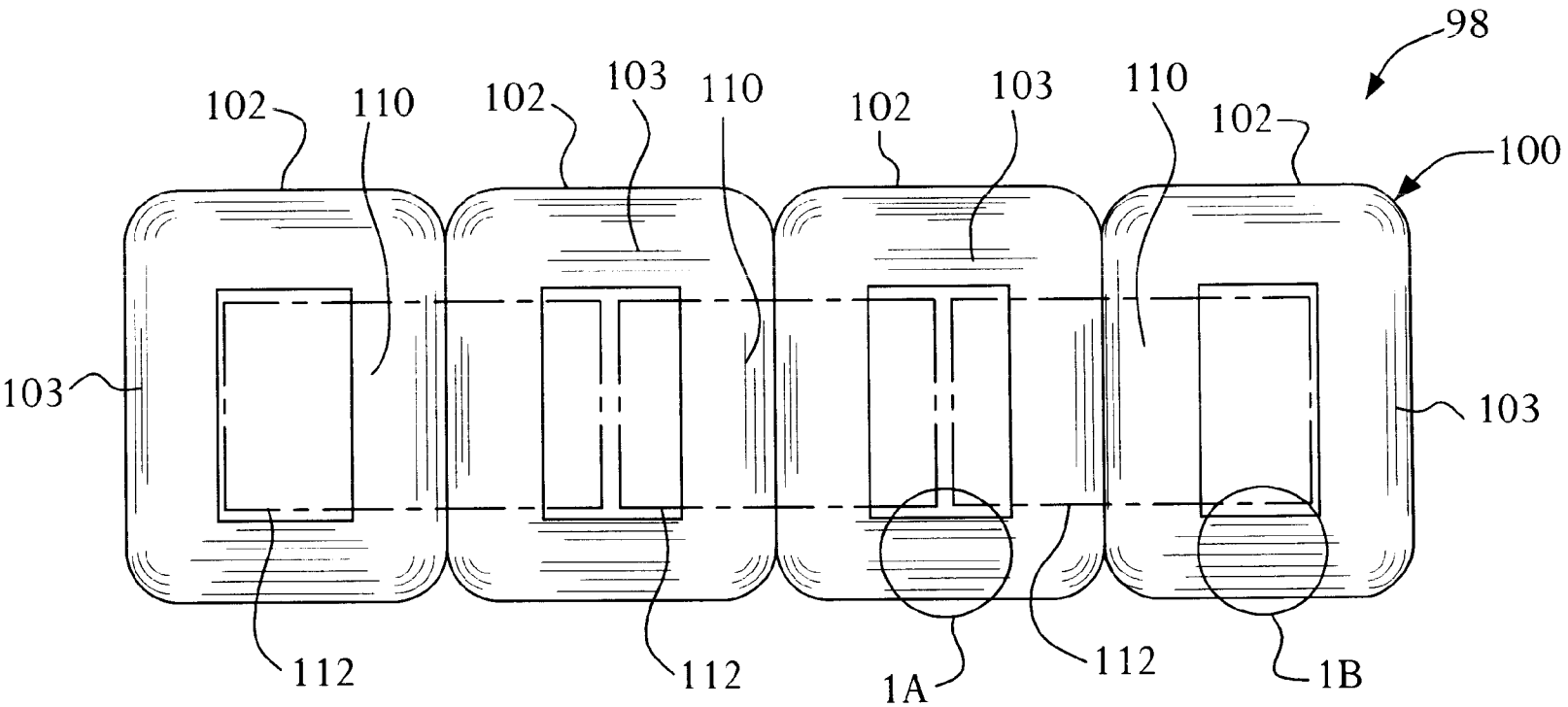
FIG. 1 PRIOR ART
FIG. 1 is a diagrammatic elevational view of a three-phase electrical-power transformer having a conventional four-loop, five-legged core.
Figure 1B:
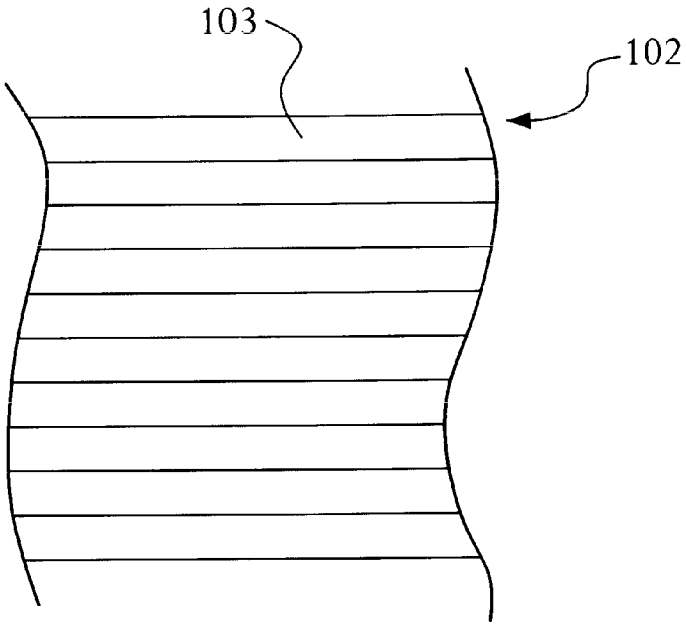
FIG. 1B is a magnified view of the area designated "1B" in FIG. 1.
Figure 1A:
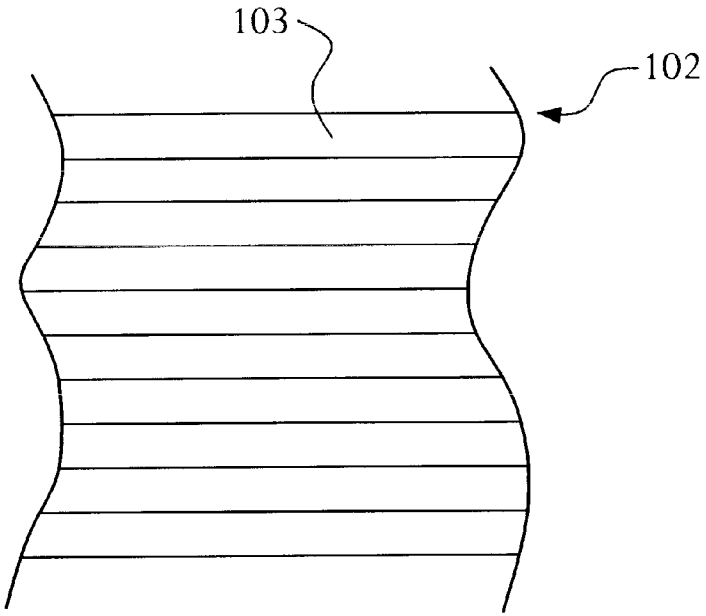
FIG. 1A is a magnified view of the area designated "1A" in FIG. 1.
Figure 2:
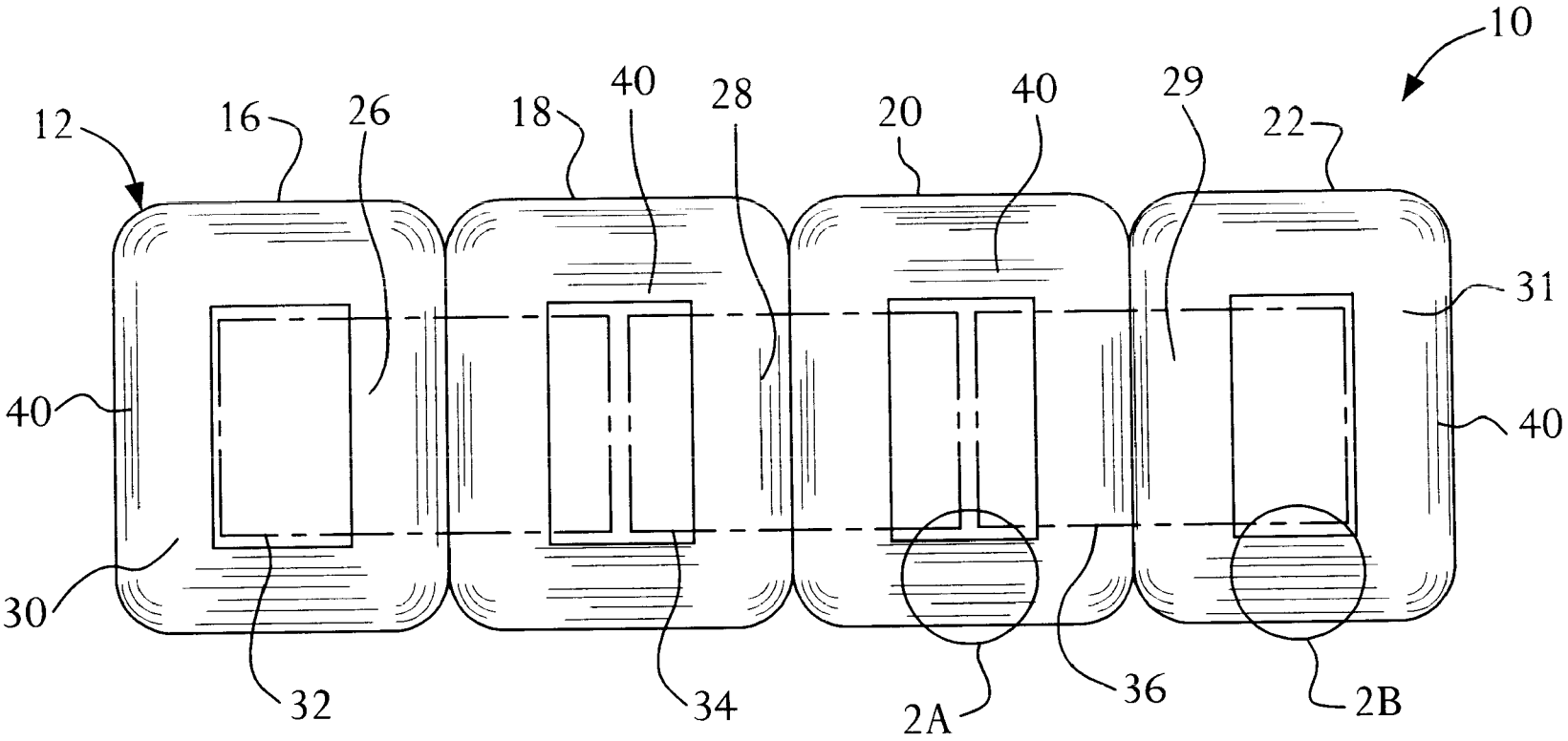
FIG. 2 is a diagrammatic elevational view of a three-phase electrical-power transformer having a four-loop, five-legged core constructed in accordance with the present invention.

FIG. 2 is a diagrammatic illustration of a transformer 10 comprising a core 12 constructed in accordance with the present invention. Details of the transformer 10 in addition those shown in FIG. 2 are not necessary for an understanding of the invention, and therefore are not included in the figure.

The core 12 comprises a first magnetic loop 16, a second magnetic loop 18, a third magnetic loop 20, and a fourth magnetic loop 22. The first, second, third, and fourth magnetic loops 16, 18, 20, 22 are arranged substantially side by side in the recited order to form a first winding leg 26, a second winding leg 28, a third winding leg 29, a first outer leg 30, and a second outer leg 31. In other words, the second magnetic loop 18 is positioned between the first and the third magnetic loops 16, 20, and the third magnetic loop 20 is positioned between the second and fourth magnetic loops 18, 22. The first and the fourth magnetic loops 16, 22 thus form outer loops of the core 12, and the second and the third magnetic loops 18, 20 form inner loops of the core 12. (The first and the fourth magnetic loops 16, 22 are hereinafter collectively referred to as "the outer loops 16, 22." The second and the third magnetic loops 18, 20 are hereinafter collectively referred to as "the inner loops 18, 20.")

The transformer 10 further comprises a first phase winding 32, a second phase winding 34, and a third phase winding 36 (shown in phantom in FIG. 2). The first phase winding 32 encircles the first winding leg 26 so that the first phase winding 32 and the first winding leg 26 are inductively coupled when the transformer 10 is energized. The second phase winding 34 likewise encircles the second winding leg 28 so that the second phase winding 34 and the second winding leg 28 are inductively coupled when the transformer 10 is energized. The third phase winding 36 encircles the third winding leg 29 so that the third phase winding 36 and the third winding leg 29 are inductively coupled when the transformer 10 is energized.

Figure 2B:
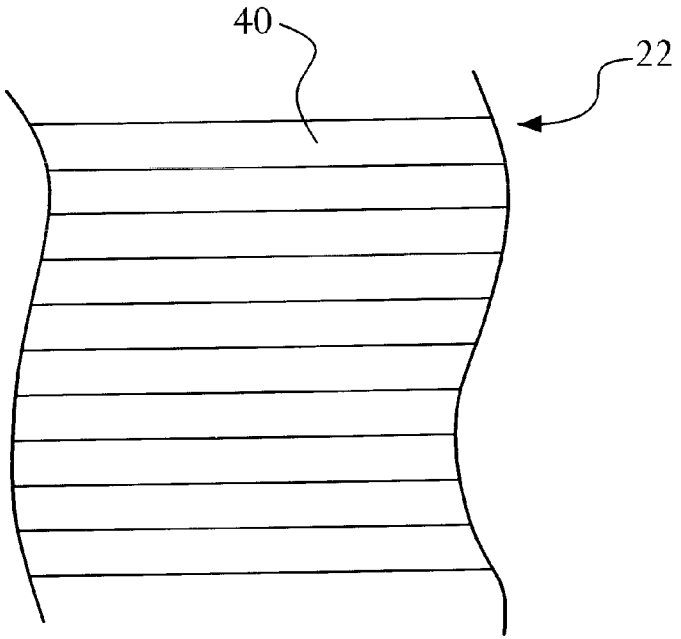
FIG. 2B is a magnified view of the area designated "2B" in FIG. 2.
Figure 2A:
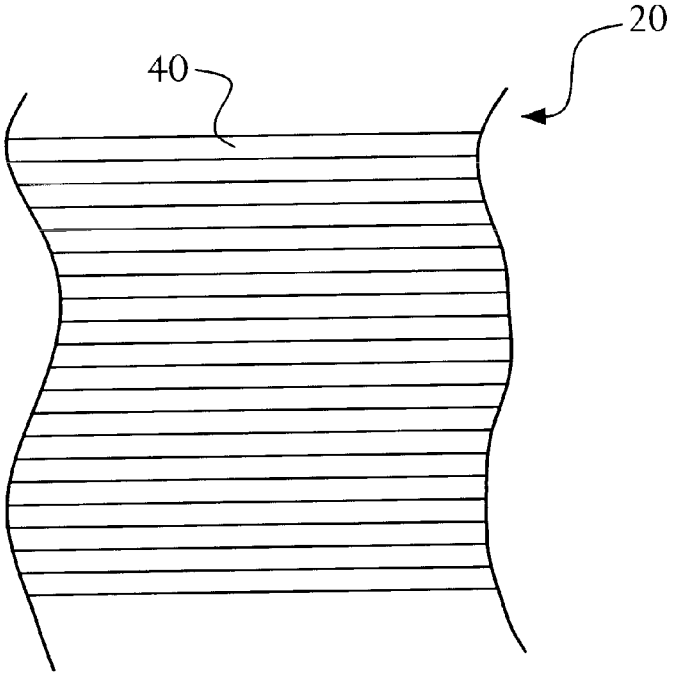
FIG. 2A is a magnified view of the area designated "2A" in FIG. 2.

Details concerning the construction of the magnetic loops 16, 18, 20, 22 are as follows. The magnetic loops 16, 18, 20, 22 are each formed by winding a thin, continuous strip of magnetic material into the shape depicted in FIG. 2. In other words, each of the magnetic loops 16, 18, 20, 22 is made up of a plurality of laminae 40 formed by a single winding of magnetic material. FIGS. 2A and 2B are diagrammatic illustrations depicting portions of the laminae 40 of the inner loop 20 and the outer loop 22, respectively. The sizes of the laminae 40 are exaggerated in these figures, for clarity. The magnetic material used to form the magnetic loops 16, 18, 20, 22 may be, for example, textured silicon steel.

In accordance with the present invention, the outer loops 16, 22 of the core 12 are each formed from a continuous strip of magnetic material having a first thickness, and the inner loops 18, 20 are each formed from a continuous strip of magnetic material having a second thickness, with the second thickness being less than the first thickness (see FIGS. 2A and 2B). For example, the outer magnetic loops 16, 22 may be formed from a strip of material having a thickness of eleven mils, while the inner magnetic loops 18, 20 may be formed from a strip of material having a thickness of nine mils.

Forming the outer loops 16, 22 and the inner loops 18, 20 from materials having disparate thicknesses causes the levels of inductance within the first, second, and third winding legs 26, 28, 29 to differ when the transformer 10 is energized. Hence, the combined core losses in the outer loops 16, 22 differ from those in the inner loops 18, 20. Applicants have discovered, however, that the overall core losses in the transformer 10 are not necessarily equal to the numerical average of the core losses in the outer loops 16, 22 and the inner loops 18, 22. As a corollary to this discovery, Applicants have found that changes in average value of the core losses in the outer loops 16, 22 and the inner loops 18, 22 do not necessarily produce a proportionate change in the overall core losses in the transformer 10. Applicants have recognized that this concept can be exploited in the following manner to reduce the cost of manufacturing a transformer having core losses of a given value.

Increasing the thickness of the material used to form a magnetic loop for a transformer core such as the core 12 generally leads to an increase in the core losses associated with that magnetic loop. Increases in material thickness, however, generally reduce the initial cost of the magnetic loop. This potential cost savings has not heretofore been exploited due to the widely-held belief among skilled transformer designers that the overall core losses in a transformer are equal to the numerical average of the core losses in each of the individual magnetic loops, regardless of whether the loops are operating under identical conditions. In other words, the currently-accepted teachings in the field of transformer design indicate that increasing the thickness of the material used to form the magnetic loops will reduce the initial cost of a transformer, but will produce a proportionate increase in the overall core losses of the transformer regardless of whether the individual loops are operated under identical conditions.

Contrary to the above-stated belief, Applicants have discovered that increasing the core losses in one but not all of the magnetic loops of a transformer core does not produce a proportionate increase in the overall core losses of the transformer. In fact, Applicants have found that, under these circumstances, the overall core losses increase at a rate that is lower than the rate of increase in the numerical average of the core losses in the individual loops. Hence, a transformer having overall core losses of a given value can be produced by constructing two or more magnetic loops of the transformer core from materials having different thicknesses, where the thicknesses are chosen so as to produce a given value for the overall core losses of the transformer. The cost of this transformer, in theory, will be less than the cost of a transformer having comparable overall core losses and comprising magnetic loops formed from materials all having the same thickness.

Applicants have conducted experiments that verify the above-stated findings. Results of these experiments are presented in tabular form in FIG. 3. Experiments were conducted using a first conventional transformer having a core formed by four magnetic loops each wound from a strip of nine-mil-thick electrical steel. The nine-mil magnetic loops are hereby assigned the designation "A." Hence, the first conventional transformer was equipped with a core having an "A-A-A-A" configuration.

Data was also generated using a second conventional transformer having a core formed by four magnetic loops each wound from a strip of fourteen-mil-thick electrical steel. The fourteen-mil magnetic loops are hereby assigned the designation "B." Hence, the second conventional transformer was equipped with a core having a "B-B-B-B" configuration. The data associated with the first and the second conventional transformers is hereinafter referred to as "baseline" data.

Experimental data was also generated using a first transformer constructed in accordance with the present invention. The core of this transformer comprised four magnetic loops. The two outer loops were formed from fourteen-mil-thick electrical steel, and the two inner loops were formed from nine-mil-thick electrical steel. Hence, the core of this transformer was configured in a "B-A-A-B" arrangement.

A second four-loop transformer constructed in accordance with the present invention was also used to generate experimental data. A first of this transformer's outer loops was formed from nine-mil-thick electrical steel, and the adjacent inner loop was fourteen-mil electrical steel. The other inner loop was formed from nine-mil electrical steel, and the second outer loop was formed from fourteen-mil electrical steel. Hence, the core of this transformer was configured in an "A-B-A-B" arrangement.

Experimental data was also generated using a third four-loop transformer constructed in accordance with the present invention. The two outer loops of this transformer were formed from nine-mil-thick electrical steel, and the two inner loops were formed from fourteen-mil-thick electrical steel. Hence, the core of this transformer was configured in an "A-B-B-A" arrangement.

The first column of FIG. 3 represents the levels of induction, in teslas, at which data from the above-noted transformers was acquired. The second column of FIG. 3 contains baseline data generated using the first and the second conventional transformers. In particular, the data in the second column represents the numerical average of the total core losses in the first and the second conventional transformers measured when those transformers were operated at the corresponding levels of induction. This data is hereinafter referred to as the "baseline loss" for the corresponding level of induction.

The third column of FIG. 3 represents the numerical average of the total core losses measured in the first experimental transformer, i.e., the transformer having the "B-A-A-B" core configuration, when that transformer was operated at the corresponding levels of induction. (The values enclosed by brackets in FIG. 3 represent the reduction in the core losses of the experimental transformers in relation to the corresponding baseline loss, expressed as a percentage of the baseline loss.)

The fourth column of FIG. 3 represents the numerical average of the total core losses measured in the second experimental transformer, i.e., the transformer having the "A-B-A-B" core configuration, when that transformer was operated at the corresponding levels of induction. The fifth column of FIG. 3 represents the numerical average of the total core losses measured in the third experimental transformer, i.e., the transformer having the "A-B-B-A" core configuration, when that transformer was operated at the corresponding levels of induction.

The data presented in FIG. 3 demonstrates that substantial reductions in core losses can be achieved through the use of the present invention. For example, the core losses measured in the transformer having the "A-B-A-B" core configuration were ten percent less than the baseline losses at a level of induction of one tesla.

Reducing the core losses in a transformer such as the transformer 10 can lead to substantial reductions the initial cost of a transformer. In particular, a transformer having overall core losses of a given value can be produced by forming two or more magnetic loops of the core from materials having different thicknesses, and choosing the thicknesses so as to produce the given value of core losses. In accordance with the above-described findings of the Applicants, one or more of the magnetic loops of this transformer can be constructed from a thicker material than the magnetic loops of a conventional transformer having comparable core losses. The noted cost savings is a result of the cost difference between the thicker material and the more-expensive thinner material. This cost savings can be substantial due to the relatively high cost of the specialized materials from which transformer core are typically manufactured.

It is to be understood that even though numerous characteristics and advantages of the present invention have been set forth in the foregoing description, together with details of the structure and function of the invention, the disclosure is illustrative only, and changes may be made in detail, especially in matters of shape, size, and arrangement of the parts, within the principles of the invention to the full extent indicated by the broad general meaning of the terms in which the appended claims are expressed.

For example, the concepts of the invention can be applied to transformer cores other than the four-loop, five-legged core 12 of the transformer 10. In fact, the concepts of the invention can be applied to virtually any transformer core comprising more than one magnetic loop. Furthermore, the magnetic loops formed from the relatively thin material do not necessarily have to be the inner loops of the core, as in the exemplary core 12. For example, the benefits of the invention could be achieved by forming the outer loops 16, 22 of the exemplary core 12 from the thinner (nine-mil) material, and forming the inner loops 18, 20 from the thicker (eleven-mil) material. Alternatively, the outer loop 16 and the non-adjacent inner loop 20 may be formed from the thinner (or thicker) material, while the outer loop 22 and the non-adjacent inner loop 18 are formed from the thicker (or thinner) material.

The thickness of the material strips used to form the magnetic loops 16, 18, 20, 22 is specified herein for exemplary purpose only. The invention is equally applicable to magnetic loops formed from material strips having a greater or lesser thickness than those specified herein. Furthermore, although the invention has been described in relation to a continuously-wound core, the invention is also applicable to cut-wound cores. In addition, the invention can be applied to core-type transformers as well as shell-type transformers such as the transformer 10.

What is claimed is:

1. An electrical-power transformer, comprising:

a core comprising a first magnetic loop including a first winding formed by a first strip of magnetic material having a first thickness, and a second magnetic loop including a second winding formed by a second strip of magnetic material having a second thickness, wherein the second thickness is less than the first thickness and the first and the second magnetic loops are positioned substantially side by side so that the first and the second magnetic loops form a winding leg; and a phase winding encircling the winding leg so that the phase winding and the winding leg are inductively coupled when the transformer is energized.

2. The electrical-power transformer of claim 1, wherein the first thickness is approximately eleven mils and the second thickness is approximately nine mils.

3. The electrical-power transformer of claim 1, wherein the first and the second windings are continuous windings.

4. An electrical-power transformer, comprising:

a core comprising a first magnetic loop including a first plurality of laminae each having a first thickness, and a second magnetic loop including a second plurality of laminae each having a second thickness, wherein the second thickness is less than the first thickness and the first and the second magnetic loops are positioned substantially side by side so that the first and the second magnetic loops form a winding leg; and a phase winding encircling the winding leg so that the phase winding and the winding leg are inductively coupled when the transformer is energized.

5. The electrical-power transformer of claim 4, wherein the first thickness is approximately eleven mils and the second thickness is approximately nine mils.

6. The electrical-power transformer of claim 4, wherein the first plurality of laminae is formed by a first winding of magnetic material and the second plurality of laminae is formed by a second winding of magnetic material.

7. The electrical-power transformer of claim 6, wherein the first and the second windings of magnetic material are continuous windings.

8. A core for a three-phase electrical-power transformer, comprising a first, a second, a third, and a fourth magnetic loop, the first, second, third, and fourth magnetic loops being positioned substantially side by side in the recited order to provide three winding legs and two outer legs, wherein:

the first magnetic loop includes a first winding formed by a first strip of magnetic material having a first thickness;

the second magnetic loop includes a second winding formed by a second strip of magnetic material having a second thickness;

the third magnetic loop includes a third winding formed by a third strip of magnetic material having substantially the second thickness; and the fourth magnetic loop includes a fourth winding formed by a fourth strip of magnetic material having substantially the first thickness.

9. The core of claim 8, wherein the first thickness is greater than the second thickness.

10. The core of claim 9, wherein the first thickness is approximately eleven mils and the second thickness is approximately nine mils.

11. The core of claim 8, wherein the first, second, third, and fourth windings are continuous windings.

12. A core for a three-phase electrical-power transformer, comprising a first, a second, a third, and a fourth magnetic loop, the first, second, third, and fourth magnetic loops being positioned substantially side by side in the recited order to provide three winding legs and two outer legs, wherein:

the first magnetic loop includes a first plurality of laminae each having a first thickness;

the second magnetic loop includes a second plurality of laminae each having a second thickness;

the third magnetic loop includes a third plurality of laminae each having substantially the second thickness; and the fourth magnetic loop includes a fourth plurality of laminae each having substantially the first thickness.

13. The core of claim 12, wherein the first thickness is greater than the second thickness.

14. The core of claim 13, wherein the first thickness is approximately eleven mils and the second thickness is approximately nine mils.

15. The core of claim 12, wherein the first plurality of laminae is formed by a first winding of magnetic material, the second plurality of laminae is formed by a second winding of magnetic material, the third plurality of laminae is formed by a third winding of magnetic material, and the fourth plurality of laminae is formed by a fourth winding of magnetic material.

16. The core of claim 15, wherein the first, second, third, and fourth windings of magnetic material are continuous windings.

17. A core for a magnetic-induction device, comprising:

a first magnetic loop including a first winding formed by a first strip of magnetic material having a first thickness; and a second magnetic loop including a second winding formed by a second strip of magnetic material having a second thickness, wherein the second thickness is less than the first thickness and the first and the second magnetic loops are positioned substantially side by side so that the first and the second magnetic loops form a winding leg for a phase winding.

18. The core of claim 17, wherein the first thickness is approximately eleven mils and the second thickness is approximately nine mils.

19. The core of claim 17, wherein the first and the second windings are continuous windings.

20. A core for a magnetic-induction device, comprising:

a first magnetic loop including a first plurality of laminae each having a first thickness; and a second magnetic loop including a second plurality of laminae each having a second thickness, wherein the second thickness is less than the first thickness and the first and the second magnetic loops are positioned substantially side by side so that the first and the second magnetic loops form a winding leg for a phase winding.

21. The core of claim 20, wherein the first thickness is approximately eleven mils and the second thickness is approximately nine mils.

22. The core of claim 20, wherein the first plurality of laminae is formed by a first winding of magnetic material and the second plurality of laminae is formed by a second winding of magnetic material.

23. The core of claim 22, wherein the first and the second windings of magnetic material are continuous windings.

* * * * *